United States Patent [19]

Widder et al.

[11] 4,344,862

[45] Aug. 17, 1982

[54] REACTION PRODUCTS OF SULFONAMIDO-CARBOXYLIC ACIDS OR CARBOXAMIDO-CARBOXYLIC ACIDS WITH ALKANOLAMINES, AND THEIR USE AS LOW-FOAMING CORROSION INHIBITORS

[75] Inventors: Rudi Widder, Leimen; Elmar Getto, Mannheim; Albert Hettche, Hessheim, all of Fed. Rep. of Germany

[73] Assignee: BASF Aktiengesellschaft, Ludwigshafen, Fed. Rep. of Germany

[21] Appl. No.: 199,059

[22] Filed: Oct. 20, 1980

[30] Foreign Application Priority Data

Nov. 24, 1979 [DE] Fed. Rep. of Germany ..... 2947418

[51] Int. Cl.[3] ..... C23F 11/16; C23F 11/14; C23F 11/12

[52] U.S. Cl. ..... 252/391; 106/14.18; 252/8.55 E; 252/77; 252/78.1; 252/87; 252/180; 252/181; 252/389 R; 260/465 D; 260/501.11; 260/501.12; 422/12; 422/13; 422/16; 422/17

[58] Field of Search ..... 252/391, 392, 389 R, 252/394, 8.55 E, 77, 78.1, 87, 180, 181; 260/465 D, 501.11, 501.12; 422/12, 13, 16, 17; 106/14.13, 14.19

[56] References Cited

U.S. PATENT DOCUMENTS

| | | | |
|---|---|---|---|
| 2,578,725 | 12/1951 | Michel et al. | 252/391 |
| 2,908,648 | 10/1959 | Spivack et al. | 252/391 |
| 3,556,994 | 1/1971 | Diery | 252/389 |
| 4,060,522 | 11/1977 | Kindscher et al. | 260/501.12 |

FOREIGN PATENT DOCUMENTS 900041 11/1953 Fed. Rep. of Germany .

OTHER PUBLICATIONS

Ziolkowsky, "Seifo, Öle, Fette, Wachse" 103, No. 6, (1977), pp. 167–168.

*Primary Examiner*—Irwin Gluck
*Attorney, Agent, or Firm*—Oblon, Fisher, Spivak, McClelland & Maier

[57] ABSTRACT

Products which have been obtained by reacting an acid of the formula I

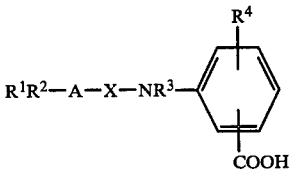

I where $R^1$ and $R^2$ are hydrogen, fluorine, chlorine, bromine or alkyl or alkoxy of 1 to 4 carbon atoms, but the sum of the carbon atoms of $R^1$ and $R^2$ is not greater than 7 and preferably not greater than 3, A is a benzene, naphthalene or anthracene radical or a biphenyl structure, such as a diphenyl, diphenylmethane, diphenyl ether, diphenyl sulfide, diphenyl sulfoxide or diphenyl sulfone radical, $R^3$ is hydrogen, alkyl of not more than 4 carbon atoms, β-cyanoethyl or hydroxyalkyl of 2 to 4 carbon atoms, $R^4$ is hydrogen, fluorine, chlorine, bromine, alkyl or alkoxy of 1 to 4 carbon atoms, hydroxyl or carboxyl and X is $—SO_2—$ or —CO—, with an amine of the formula II

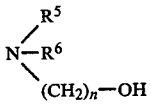

II where $R^5$ and $R^6$ are hydrogen, $C_1$–$C_4$-alkyl, $C_2$–$C_4$-hydroxyalkyl and/or

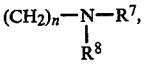

$R^7$ and $R^8$ being hydrogen, $C_1$–$C_4$-alkyl or $C_2$–$C_4$-hydroxyalkyl and n being an integer from 2 to 4, in the ratio, expressed in terms of equivalents, of from 1:1 to 1:4, and corrosion inhibitors which contain these products, with or without the admixture of an alkanolamine/boric acid reaction product.

4 Claims, No Drawings

REACTION PRODUCTS OF SULFONAMIDO-CARBOXYLIC ACIDS OR CARBOXAMIDO-CARBOXYLIC ACIDS WITH ALKANOLAMINES, AND THEIR USE AS LOW-FOAMING CORROSION INHIBITORS

The present invention relates to reaction products of sulfonamido-carboxylic acids or carboxamido-carboxylic acids with alkanolamines. It further relates to the use of these reaction products as water-soluble, low-foaming corrosion inhibitors for use under slightly acidic to alkaline conditions. Finally, it also relates to the use of these products, together with reaction products of orthoboric acid and alkanolamines, for the same purpose.

Industrial cleaning, hydraulic and cooling processes, taking place in the presence of water, always present a problem of corrosion protection if these processes entail contact between the water and metals prone to corrode, such as iron, iron alloys, aluminum or aluminum alloys.

A plurality of inhibitors has been proposed for this purpose, including, in particular, organic compounds, such as acylsarcosides, amines, alkanolamines and amides of relatively long-chain fatty acids (cf. also "Seifen, Öle, Fette, Wachse" 103, No. 6 (1977), 167–168).

However, a great problem when using these additives is severe foaming. Attempts have been made to deal with this by use of anti-foam additives, but these often modify, or even interfere with, the action of the process water. Furthermore, since such anti-foam additives are frequently expensive organic substances, they have an adverse effect on the economics of the various processes in which they are employed.

German Pat. No. 900,041 relates, inter alia, to salts of sulfonamidocarboxylic acids or carboxamidocarboxylic acids, which are obtained by reacting an aliphatic carboxylic acid chloride or sulfonic acid chloride with an aliphatic aminocarboxylic acid or aromatic aminocarboxylic acid, e.g. anthranilic acid. These salts are proposed as corrosion inhibitors.

U.S. Pat. No. 2,908,648 discloses similar products which are obtained by reacting an arylsulfonic acid halide with an exclusively aliphatic aminoacid, and which are intended for the same purpose.

U.S. Pat. No. 2,578,725 discloses similar reaction products of, for example, anthranilic acid or a preferably aliphatic aminoacid with an aliphatic sulfonic acid chloride.

German Pat. No. 1,298,672 discloses, specifically, reaction products of an arylsulfonic acid halide with an aliphatic aminocarboxylic acid.

All these conventional products have the general structural formula $$R—X—NR'—R''—COOY$$

where R and R'' are radicals of which not more than one is aromatic, X is —CO— or, in most cases, $—SO_2—$, R' is hydrogen or alkyl and Y is hydrogen, a metal ion or an unsubstituted or substituted ammonium ion.

These previously described products possess good corrosion-inhibiting properties and some of them are also low-foaming; however, they are not entirely satisfactory, in particular as regards the corrosion protection afforded in saline water.

It is an object of the present invention to provide products which afford excellent corrosion protection, coupled with low foaming, in processes where iron, iron alloys, aluminum or aluminum alloys, or copper, zinc or their alloys, come into contact with water and especially with hard and saline water.

We have found that, surprisingly, this object is achieved with products which are obtained by reaction of an acid of the formula I

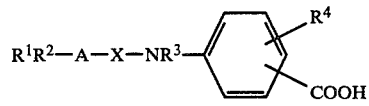

I where $R^1$ and $R^2$ are hydrogen, fluorine, chlorine, bromine or alkyl or alkoxy of 1 to 4 carbon atoms, but the sum of the carbon atoms of $R^1$ and $R^2$ is not greater than 7 and preferably not greater than 3, A is a benzene, naphthalene or anthracene radical or a biphenyl structure, such as a diphenyl, diphenylmethane, diphenyl ether, diphenyl sulfide, diphenyl sulfoxide or diphenyl sulfone radical, $R^3$ is hydrogen, alkyl of not more than 4 carbon atoms, β-cyanoethyl or hydroxyalkyl of 2 to 4 carbon atoms, $R^4$ is hydrogen, fluorine, chlorine, bromine, alkyl or alkoxy of 1 to 4 carbon atoms, hydroxyl or carboxyl and X is $—SO_2—$ or —CO—, with an amine of the formula II

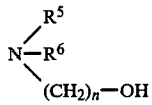

II where $R^5$ and $R^6$ are hydrogen, $C_1$–$C_4$-alkyl, $C_2$–$C_4$-hydroxyalkyl and/or

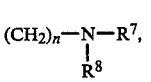

$R^7$ and $R^8$ being hydrogen, $C_1$–$C_4$-alkyl or $C_2$–$C_4$-hydroxyalkyl and n being an integer from 2 to 4, in the ratio, expressed in terms of equivalents, of from 1:1 to 1:4.

Further, we have found that this object is also achieved with mixtures of the above products with up to 85% by weight, based on the said products, of one or more reaction products of orthoboric acid with one or more alkanolamines of 2 to 4 carbon atoms per alkanol group, the orthoboric acid and alkanolamine having been reacted in a molar ratio of from 1:1 to 1:4.

These products or product mixtures are excellent low-foaming corrosion inhibitors which provide very good corrosion protection even in extremely hard and saline water.

The acids of the formula I, which are reacted with alkanolamines of the formula II, also conform to the structural principle of the general formula of the prior art products, mentioned above, except that according to the invention R and R'' are exclusively aromatic radicals.

In view of the fact that according to the prior art discussed above, one of the radicals R and R'' must always be aliphatic, and that a great many variations, within this condition, were tried in the 4 cited Patents without the conditions according to the present invention having been in any way suggested, even in passing, the present invention overcomes an evidently existing prejudice against the reaction of aromatic aminocarboxylic acids with aromatic acid halides in order to obtain products for the industrial purpose in question. Furthermore, the free acids of the formula I are compounds listed in Beilstein (cf. Liebigs Annalen der Chemie, 367 (1909), 110; Beilstein, Volume 14, System No. 1901–1902), so that for this reason alone their use as an inhibitor should have suggested itself.

The acids of the formula I are obtainable by conventional methods, cf. the literature reviewed in Beilstein. However, for industrial purposes the reaction mainly of importance is that of an aromatic acid halide, preferably a chloride, with an aromatic aminocarboxylic acid.

Accordingly, one of the starting materials in the present invention is an acid chloride of the formula III $$R^1R^2—A—X—Hal \qquad III$$

where $R^1$, $R^2$, A and X are defined as for formula I, and Hal is chlorine, bromine or iodine.

Examples of aromatics from which the carboxylic acid chlorides and the (preferred) sulfochlorides are derived are benzene, fluorobenzene, chlorobenzene, bromobenzene, toluene, xylene, naphthalene, methylnaphthalenes, dimethylnaphthalenes, anthracene, biphenyl, diphenylmethane, diphenyl ether, diphenylsulfoxide and diphenylsulfone.

Preferred acid chlorides are benzenesulfochloride, o- and p-toluenesulfochloride, p-xylenesulfochloride and, amongst the carboxylic acid chlorides, especially benzoyl chloride, naphthoyl chloride and p-toluenecarboxylic acid chloride.

The aromatic aminocarboxylic acid which is reacted with the acid chloride has the formula IV

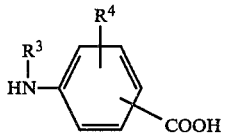

IV where $R^3$ and $R^4$ are as defined for formula I.

In formula IV, $R^3$ and $R^4$ are preferably hydrogen and $R^4$ may also be carboxyl; particular examples of the aminocarboxylic acids are anthranilic acid (o-aminobenzoic acid), p-aminobenzoic acid and the aminobenzenedicarboxylic acids.

The sulfonamidocarboxylic acids and carboxamidocarboxylic acids are obtained by prior art methods (cf. Liebigs Annalen, loc. cit.) which do not require detailed explanation here. They are subsequently reacted with alkanolamines of the formula II. In this formula, $R^5$ and $R^6$ may be identical or different and each is preferably an ethanol or isopropanol radical, methyl or $$-(CH_2)_n-\underset{\underset{R^8}{|}}{N}-R^7$$

where $R^7$ and $R^8$ which may be identical or different are each an ethanol or isopropanol radical and n is 2.

Preferred alkanolamines are, specifically, triethanolamine, triisopropanolamine, tri-n-propanolamine, methyldiethanolamine and methyldiisopropanolamine, and ethylenediamine which has been reacted with one mole of ethylene oxide or of propylene oxide per active H atom.

The ratio, in terms of equivalents, in which the amidocarboxylic acid and the alkanolamine are reacted is from 1:1 to 1:4, preferably from 1:1.4 to 1:2. The reaction, which can be effected by simply mixing the reactants, whilst stirring, with or without cooling of the reaction vessel, results in salts (containing one equivalent of each component) or in mixtures of the salts with free alkanolamine; such mixtures can also be employed direct as inhibitors.

In addition, the inhibitors may contain up to 85% by weight, preferably up to 50% by weight, based on the reaction products described, of products obtained by reaction of orthoboric acid with an alkanolamine. These latter products are proposed, as components of another corrosion inhibitor system, in German Patent Application DE-OS 29 08 301.

The products are prepared from monoalkanolamines, dialkanolamines or trialkanolamines of 2 or 3 carbon atoms per alkanol group, or from mixtures of such alkanolamines.

Amongst the various alkanolamines, the dialkanolamines are preferred. Mixtures obtained when preparing alkanolamines by oxyalkylation of ammonia are particularly useful for the industrial preparation of the above products. Such mixtures contain the dialkanolamine as the main component, with lesser proportions of monoalkanolamine and trialkanolamine.

Specifically, preferred compounds are diethanolamine, diisopropanolamine and the mixtures which are obtained by oxyethylation or oxypropylation of ammonia and which in the main contain diethanolamine and diisopropanolamine, respectively.

Further suitable alkanolamines are those where the nitrogen atom is monosubstituted by methyl, ethyl, n-propyl or isopropyl, e.g. methyldiethanolamine, ethyldiethanolamine, isopropyldiethanolamine and the corresponding derivatives of diisopropanolamine, and mixtures of these compounds which can be obtained by oxyalkylation of the corresponding primary amines.

The reaction of the boric acid with the alkanolamines (hereafter simply referred to by this term, for simplicity) is carried out in a molar ratio of $H_3BO_3$: alkanolamine of from 1:1 to 1:4, the value depending on the proportion of monoalkanolamine, dialkanolamine and trialkanolamine in the material used. If mixtures containing the dialkanolamine as the main component are used, the ratio is preferably 2:3 (1:1.5).

The reaction may be carried out, for example, by reacting the boric acid and alkanolamine in a reaction vessel, under reduced pressure, namely from 0.01 to 0.1 bar, at from 20° to 100° C., preferably from 60° to 100° C., with vigorous mechanical agitation, the water formed in the reaction being removed continuously by distillation. Depending on the molar ratio of the reactants, differing molar amounts of water are eliminated. If, for example, the main constituent (of the alkanolamine mixture) is the dialkanolamine, and the reaction is carried out with a molar ratio of $H_3BO_3$: alkanolamine=2:3, from about 5 to 6 moles of water are eliminated. The reaction, which is a condensation, in that case requires from about 1.5 to 3 hours.

Of course, the reaction can also be carried out under higher pressures, for example under atmospheric pressure, but in that case the removal of the water of reaction proves more difficult and there is a greater danger that, due to hydrolysis by water which is being removed insufficiently rapidly, the reaction may be reversed at the substantially higher temperatures required.

Finally, it is also possible to employ simple salts of orthoboric acid with alkanolamines; these salts are formed by simply mixing the individual components, in the above ratios.

The corrosion inhibitors according to the invention can be employed in all aqueous systems which come into contact with iron, its alloys (steels), aluminum, its alloys, zinc or copper or their alloys. Examples include hydraulic fluids, cooling lubricants, neutral or alkaline industrial cleaners, and pit water, which is particularly hard and saline, such pit water being used direct, in mining, as mixing water in, for example, hydraulic processes and being particularly corrosive.

The concentrations at which the inhibitors according to the invention are used differ according to the particular application and the nature of the aqueous medium and of the metals to be protected. In general from 0.01 to 5% by weight, based on the aqueous formulation, is employed. Below this range, the protective action diminishes, whilst exceeding the range offers no additional advantages. Preferably, the concentration should be from 0.1 to 3% by weight.

The Examples which follow illustrate the invention.

EXAMPLES

The following compounds were tested:

EXAMPLE 1

Triethanolamine salt of N-phenylsulfonylanthranilic acid.

EXAMPLE 2

Triethanolamine salt of N-(o-tolylsulfonyl)-anthranilic acid.

EXAMPLE 3

Triethanolamine salt of N-(xylylsulfonyl)-anthranilic acid.

EXAMPLE 4

Triethanolamine salt of N-benzoyl-anthranilic acid.

COMPARATIVE EXAMPLE 1

Triethanolamine salt of N-undecylcarbonylanthranilic acid, according to German Pat. No. 900,041.

COMPARATIVE EXAMPLE 2

Triethanolamine salt of N-heptadecylcarbonylanthranilic acid, according to German Pat. No. 900,041.

COMPARATIVE EXAMPLE 3

Triethanolamine salt of N-oleyl-anthranilic acid.

COMPARATIVE EXAMPLE 4

Triethanolamine salt of N-$C_{13-17}$-alkylsulfonylanthranilic acid, according to U.S. Pat. No. 2,578,725.

COMPARATIVE EXAMPLE 5

Triethanolamine salt of N-tolylsulfonylsarcosine, according to U.S. Pat. No. 2,908,648.

COMPARATIVE EXAMPLE 6

Triethanolamine salt of N-methyl-N-phenylsulfonylaminocaproic acid, according to German Pat. No. 1,298,672 (compound 5).

The compounds were obtained in a conventional manner by reacting the particular acid chloride with the appropriate aminocarboxylic acid and then reacting the product with triethanolamine.

The corrosion test was carried out as follows:

Cast iron filter test

A Schwarzband circular filter paper is placed in a Petri dish of about 10 cm internal diameter, having a fitting cover dish. 5 to 10 g of coarse GG-20 cast iron filings are placed on the filter paper, by means of a suitable spoon, so as to create a uniform heap in the center, the heap being about 1.5 cm clear of the edge on all sides. The filings are about 5–8 mm long and must be produced from clean GG-20 cast iron without using any drilling oil or other cooling lubricant. All fines must be screened out.

5 ml of the solution or emulsion to be tested for corrosiveness are applied uniformly to the filings by means of a measuring pipette. The pH of the liquid being tested is recorded, since it is of substantial importance in assessing the results; it can, if desired, be adjusted to a particular standard value, for example 8.5. After the filings have been moistened, the cover is placed on the dish and the sample is left to stand for 2 hours under normal laboratory conditions at 23°–25° C. and about 70% relative atmospheric humidity. The cover is then removed and the filter paper is briefly inverted and floated on the surface of tapwater, which serves to remove the filings. Immediately thereafter, the filter paper, freed from the filings, is sprayed, and hence impregnated, with an indicator solution containing 1 g of potassium hexacyanoferrate (III) and 30 g of sodium chloride in 1 liter of water. The indicator is then allowed to act for 17 seconds, with the filter paper exposed to the air. Finally, the paper is thoroughly rinsed under running tapwater and is dried, exposed to air, in a moderately warm location. Depending on the corrosiveness of the medium, this procedure results in brownish yellow, yellow and/or bluish green stains, of varying intensity, on the filter paper, the brownish yellow or yellow color being regarded as the less good result. Satisfactory performance (of the corrosion inhibitor) manifests itself in the absence of any brown or yellow coloration, with at most traces of bluish green pale stains. The colors on the filter paper are completely stable and the papers can therefore be used in documentation of the experiments. The following is a suitable assessment scale:

very poor: (— —); intense, large, predominantly yellowish brown stains.

poor (—): intense, large stains with about equal proportions of yellowish brown and bluish green.

medium: (+ —); pale medium-size stains with about equal proportions of yellow and bluish green.

good: (+); very pale, small (pinhead-sized) stains with a predominant proportion of bluish green.

very good: (+ +); no stains or at most very few, very small pale bluish green stains.

Foaming

A foam-whisking method, based on DIN 53,902, was used. A simple test procedure, in which the ram bearing the perforated plate is moved manually up and down 30 times in 30 seconds and is then carefully withdrawn (the IG whisking method) proved adequate. The foam volume is read off in ml, on the graduated foam-whisking cylinder, after 1, 5 and 10 minutes. The other important data are the temperature, concentration of corrosion inhibitor and water hardness.

The results are shown in the Table which follows.

| Triethanolamine salt, in each case of 90% strength unless stated otherwise | Cast iron/filter paper test: water with an artificial 20° German hardness (DIN 51,360) 2% | tapwater, 23° German hardness 2% | tapwater, 23° German hardness 3% | Foaming (IG whisking method, 3% of inhibitor in distilled water, room temperature), in ml of foam after 10 min | pH 1% of inhibitor in water |
|---|---|---|---|---|---|
| Example 1 | ++ | ++ | ++ | 0 | 8.0 |
| Example 2 | ++ to + | ++ | ++ | 30 | 8.1 |
| Example 3 | ++ to + | ++ | ++ | 0 | 8.1 |
| Example 4 | + | + | ++ to + | 0 | 8.1 |
| Comparative Example 1 | + | + | ++ to + | 1,150 | 8.3 |
| Comparative Example 2 | + | + | ++ | 180 | 8.7 |
| Comparative Example 3 (100% strength) | ++ to + | ++ to + | ++ to + | 1,020 | 8.6 |
| Comparative Example 4 (100% strength) | − | − | − | 640 | 8.0 |
| Comparative Example 5 | −− | − | +− to − | 30 | 7.9 |
| Comparative Example 6 (85% strength) | +− | + | ++ to + | 0 | 8.3 |

We claim:

1. A product which is obtained by reacting an acid of the formula I

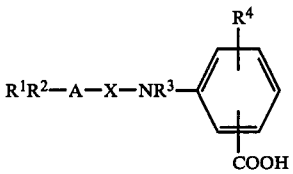

I where $R^1$ and $R^2$ are hydrogen, fluorine, chlorine, bromine or alkyl or alkoxy of 1 to 4 carbon atoms, but the sum of the carbon atoms of $R^1$ and $R^2$ is not greater than 7 and preferably not greater than 3, A is a benzene, naphthalene or anthracene radical or a biphenyl structure, $R^3$ is hydrogen, alkyl of not more than 4 carbon atoms, β-cyanoethyl or hydroxyalkyl of 2 to 4 carbon atoms, $R^4$ is hydrogen, fluorine, chlorine, bromine, alkyl or alkoxy of 1 to 4 carbon atoms, hydroxyl or carboxyl and X is $—SO_2—$ or —CO—, with an amine of the formula II

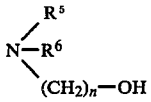

II where $R^5$ and $R^6$ are hydrogen, $C_1$–$C_4$-alkyl, $C_2$–$C_4$-hydroxyalkyl and/or

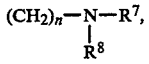

$R^7$ and $R^8$ being hydrogen, $C_1$–$C_4$-alkyl or $C_2$–$C_4$-hydroxyalkyl and n being an integer from 2 to 4, in the ratio, expressed in terms of equivalents, of from 1:1 to 1:4.

2. A low-foaming corrosion inhibitor for iron, ferrous metals, aluminum, copper, zinc or alloys comprising any of these metals, which contains a product as claimed in claim 1.

3. A corrosion inhibitor as claimed in claim 2, which additionally contains up to 85% by weight, based on the reaction product defined in claim 1, of one or more reaction products obtained from orthoboric acid and one or more alkanolamines of 2 or 3 carbon atoms per alkanol group, the orthoboric acid and alkanolamine having been used in a molar ratio of from 1:1 to 1:4.

4. The product of claim 1 wherein said biphenyl is selected from the group consisting of diphenyl, diphenylmethane, diphenyl ether, diphenyl sulfide diphenyl sulfoxide, and diphenyl sulfone radical.

* * * * *